US006360671B1

(12) United States Patent
Nakagami

(10) Patent No.: US 6,360,671 B1
(45) Date of Patent: Mar. 26, 2002

(54) FRICTION DRIVE SYSTEM TROLLEY CONVEYOR

(75) Inventor: Atsushi Nakagami, Osaka (JP)

(73) Assignee: Tsubakimoto Chain Co., Osaka (JP)

( * ) Notice: Subject to any disclaimer, the term of this patent is extended or adjusted under 35 U.S.C. 154(b) by 0 days.

(21) Appl. No.: 09/659,501

(22) Filed: Sep. 11, 2000

(30) Foreign Application Priority Data

Sep. 16, 1999 (JP) ..... 11-262473

(51) Int. Cl.[7] ..... B61B 13/00

(52) U.S. Cl. ..... 104/168; 104/106; 104/118; 105/141

(58) Field of Search ..... 104/118, 106, 104/92, 93, 107, 115, 150, 168; 105/141, 148, 149.1, 149.2

(56) References Cited

U.S. PATENT DOCUMENTS 3,903,807 A * 9/1975 Lee ..... 104/131
4,285,278 A * 8/1981 Mitchell ..... 104/96
4,368,037 A * 1/1983 Limque et al. ..... 104/93
5,690,031 A * 11/1997 Bach et al. ..... 104/168

* cited by examiner

*Primary Examiner*—S. Joseph Morano
*Assistant Examiner*—Robert J. McCarry, Jr.
(74) *Attorney, Agent, or Firm*—Howson & Howson

(57) ABSTRACT

A friction drive system trolley conveyor includes a conveyor rail having a circular cross-section, laid along a conveyor line, multiple J-shaped rail suspension members that bear the undersides of the rail at intervals in the longitudinal direction, multiple, inverted J-shaped hook members that move along the rail, engaging the upper side of the rail, a driven bar hung between hook members for suspending a conveyed article, and a friction drive embracing the driven bar on both sides to effect conveying movement. The friction drive system trolley conveyor is able to convey heavy articles in a stable manner with minimum noise and without roll, is easily constructed, installed and maintained.

6 Claims, 4 Drawing Sheets

FRICTION DRIVE SYSTEM TROLLEY CONVEYOR

BACKGROUND OF THE INVENTION

1. Field of the Invention

The present invention relates to a trolley conveyor that conveys a conveyed material or article in suspension, and specifically to a trolley conveyor for use in an automobile manufacturing line for suspending a car body from the ceiling to convey it to various processing stages such as a welding stage, a coating stage, etc.

2. Description of the Related Art

Various conveyor systems have been employed in the past to convey articles and materials in suspension. These include the ceiling-hung trolley chain conveyor, disclosed in Japanese Laid-Open Utility Model Publication No. HEI-5-37759, in which a conveyor trolley provided with a hook for hanging a conveyed article is mounted to travel freely on a conveyor rail installed in suspension from a ceiling. A large number of the conveyor trolleys are linked by conveyor chains driven so that they circulate in a closed path. Another article-suspending conveyor is the power-driven mobile ceiling carriage that has wheels traveling on a rail suspended from the ceiling. Conveyed articles are hung from the carriage. Another system utilizes a drive means such as a chain feeder or belt feeder installed on a rail suspended from a ceiling. Still another system utilizes a slanted rail, on which hangers are conveyed by virtue of their own weight.

Various problems are encountered in the conventional conveyor systems.

In the ceiling-hung trolley chain conveyor, periodic lubrication of the chains is necessary. Moreover, the sliding of the chains on the conveyor rail increases the level of noise produced by the conveyor. In addition, the maintenance, of individual trolleys is a nuisance, and the removal of individual trolleys from the conveyor, which is sometimes necessary, is also a nuisance.

Also, in the conventional ceiling mobile carriage, a collector terminal is used to feed power to the motor that drives the wheels of the carriage. Sliding abrasion created at the collector terminal stirs up dust which adheres to the conveyed material and creates piled-up spots thereon. Periodic replacement of the collector terminals is necessitated, which is disadvantageous. Moreover, since the feeder line has to be laid throughout the total length of the rail, the construction cost is burdensome.

In a hanger conveyor system using a chain feeder or a belt feeder as the drive means, the system construction becomes complicated and the system also tends to be large in size. The complexity and large size of the construction contribute to increased noise production, higher installation cost, and increased maintenance requirements.

In the case of a hanger conveyor system that utilizes the weight of the conveyed articles to carry the articles along a declining rail by gravity, the conveyor structure, and especially the drive means, are simplified. However, such a conveyor is suitable only for relatively light weight conveyed materials and articles such as clothing, which do not require a large amount of power to be conveyed. The gravity-dependent conveyor structure is not applicable to the conveyance of very heavy conveyed articles such as car bodies, which requires much larger amounts of power.

The invention addresses the aforementioned disadvantages of conventional conveyor systems, and it is an object of the invention to provide a friction drive system trolley conveyor that securely conveys heavy conveyed materials and articles with low noise stably and without roll, i.e. without rotation about an axis extending in the direction of conveyor movement, that simplifies system construction, and that facilitates maintenance work.

SUMMARY OF THE INVENTION

To achieve the foregoing object, the friction drive system trolley conveyor in accordance with the invention comprises a conveyor rail having a circular cross-section, an upper side and an underside, the rail extending in a longitudinal direction along a conveyor line; multiple J-shaped rail suspension members that bear the underside of the conveyor rail at intervals along the longitudinal direction of the conveyor rail; multiple inverted J-shaped hook members that engage and move along the upper side of the conveyor rail in the longitudinal direction; a driven bar extending between the inverted J-shaped hook members, the driven bar suspending a conveyed material or article; and friction drive means disposed along the conveyor line, the friction drive means engaging both sides of the driven bar and effecting movement of the driven bar along the conveyor line.

In one preferred embodiment, the friction drive means comprises a friction roller which engages one side of the driven bar to effect movement of the driven bar along the conveyor line and an idler roller that contacts the driven bar on the side opposite to said one side to guide the driven bar.

Preferably, the friction drive means is supported by a holding frame freely pivoted to swing on a support shaft suspended from a location above the conveyor rail.

The conveyor rail may be hollow or solid, so long as it has a circular cross-section. However, the circular cross-section of the conveyor rail is preferably hollow for lightness and strength, and to make it easier for the rail to be laid out suitably along the conveyor line.

Insofar as the mutually engaging faces of the driven bar and the friction drive means are concerned, it is possible for the faces to be respectively concave and convex. However, for optimum power transmission efficiency, both sides of the driven bar are preferably flat and the friction drive means preferably comprises circular, cylindrical rollers that engage both sides of the driven bar along lines of contact.

Further, with regard to the layout of the friction drive means in the friction drive system trolley conveyor of the invention, from the consideration of simplifying the system construction, the friction drive means are not required to be laid out in one-to-one correspondence with the driven bars, and it is especially preferable that the friction drive means be concentrated where the greatest conveyance power is needed, such as a carrying-in area, curved corner, and carrying-out area, etc. in the conveyor line.

The friction drive system trolley conveyor of the invention thus constructed exhibits the following functions.

The friction drive system trolley conveyor includes the driven, load-supporting bar hung between inverted J-shaped hook members, and a friction drive means engaging both sides of the driven bar to move the driven bar in the conveying direction. A conveying force is imparted to the bar by the friction exerted between the drive means and the bar. Thus, the friction drive system trolley conveyor exhibits a so-called friction drive function.

Further, since the friction drive system trolley conveyor is provided with a large number of inverted J-shaped hook members that move longitudinally along the upper side of the conveyor rail, the inverted J-shaped carriers roll smoothly on, and in line contact with, the rail. This suppresses contact noises which are otherwise likely to be generated at the locations at which the conveyor is supported. Thus, the friction drive system trolley conveyor also exhibits a so-called contact noise suppressing function.

In addition, the conveyor rail, and the driven bar hung between the inverted J-shaped hook members, form a ladder-like parallel linkage in a vertical plane along the conveyor line, which stabilizes the pitch attitude of the conveyed material or article. Thus, the friction drive system trolley conveyor exhibits a so-called attitude stabilizing function.

Since the driven bars are hung between inverted J-shaped hook members, even though the driven bar is straight, it can smoothly follow the locus of the arc at the curved corners of a conveyor line, both ends of the driven bar being suspended, and the bar forming a chord. Thus, the friction drive system trolley conveyor exhibits a so-called arc line following function.

Since the friction roller engages one side of the driven bar to drive the bar in the conveying direction, and the passive roller engages the other side of the driven bar to guide it, and the two rollers embrace the bar on both sides, the conveying force is transmitted smoothly to the bar by the friction roller without loss. Thus, the friction drive system trolley conveyor also displays a so-called conveyance force loss prevention function.

Finally, since the friction drive means is supported by a holding frame pivoted to swing freely on a support shaft, the friction drive means is able to rectify dislocations and kinks in the holding state, by accommodating roll of the driven bar, and lateral translation thereof as the driven bar traverses a corner in the conveyor line. Thus, the friction drive system trolley conveyor also displays a so-called holding state rectifying function.

DETAILED DESCRIPTION OF THE PREFERRED EMBODIMENT

A friction drive system trolley conveyor according to one preferred embodiment of the invention will now be described with reference to the accompanying drawings, in which the conveyor shown is employed to convey a car body in suspension to a welding process.

Figure 1:
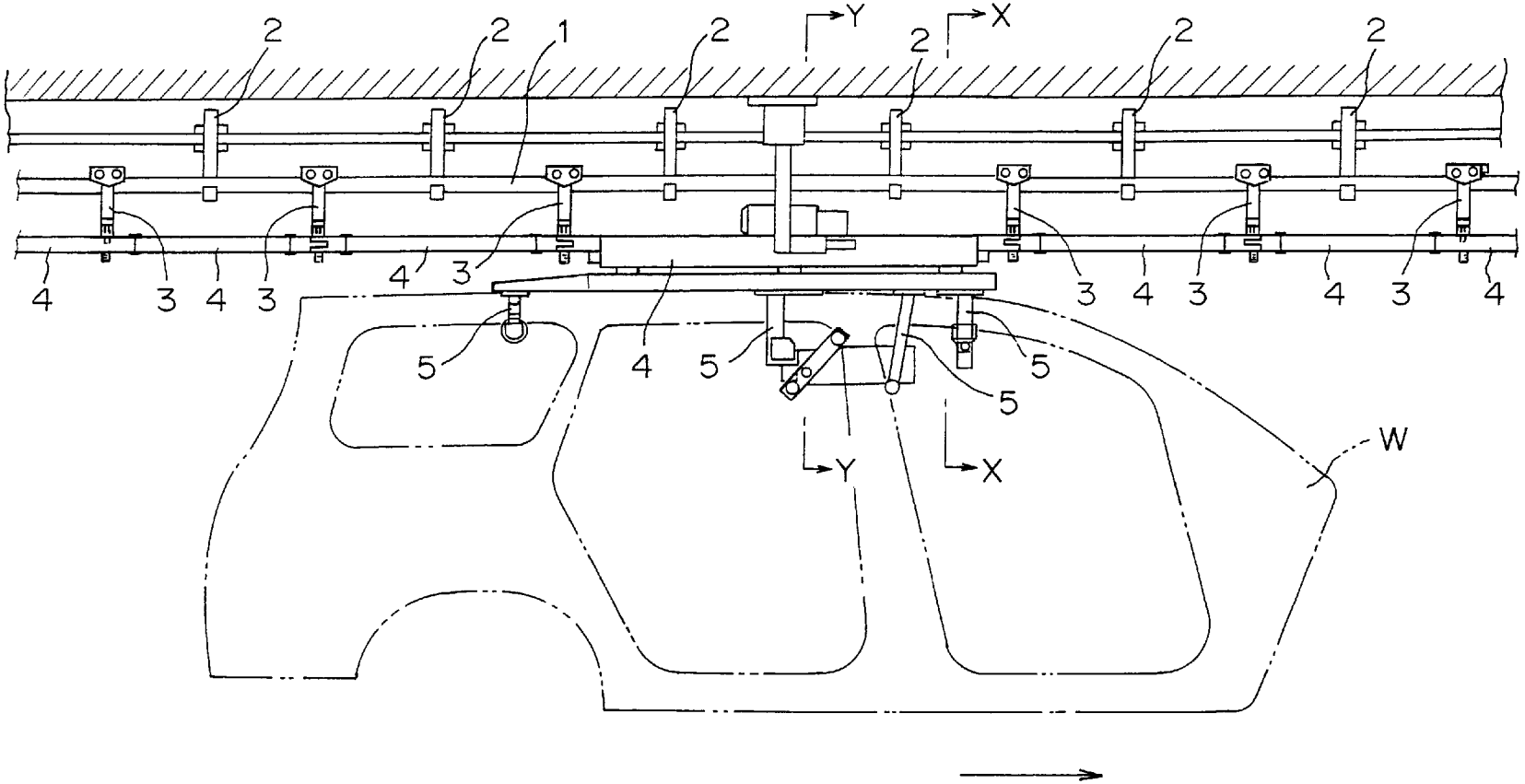
FIG. 1 is a front elevational view of a section of a friction drive system trolley conveyor according to a preferred embodiment of the invention.

As shown in FIG. 1, the conveyor includes a railway section comprising a rail 1 made of cylindrical steel pipe laid along a conveyor line, and multiple J-shaped rail suspension members 2 that bear the undersides of the rail 1 at intervals along the longitudinal direction of the rail.

Figure 2:
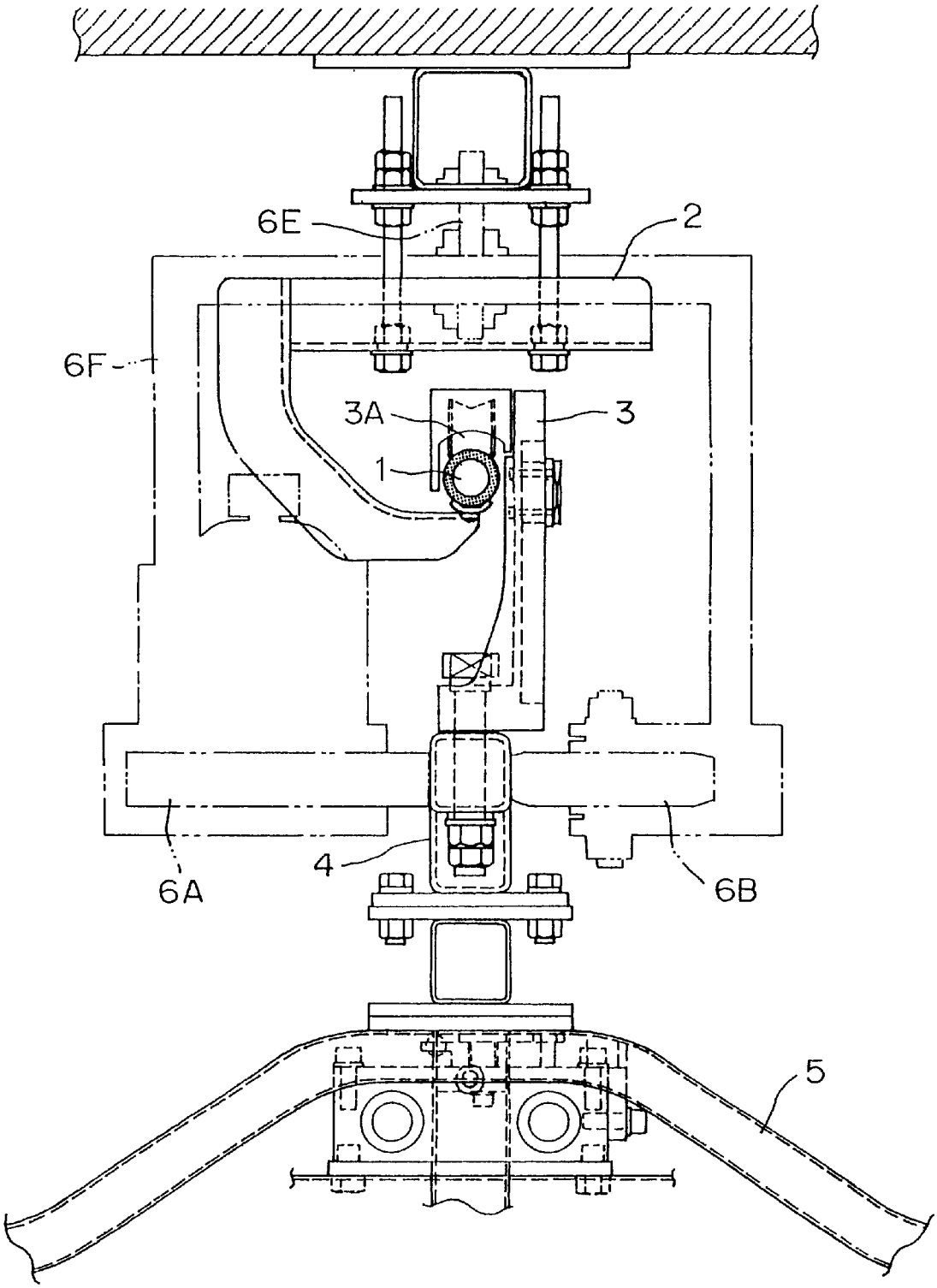
FIG. 2. is a transverse sectional view taken on plane X—X of FIG. 1, showing the conveyor in operation.
Figure 3:
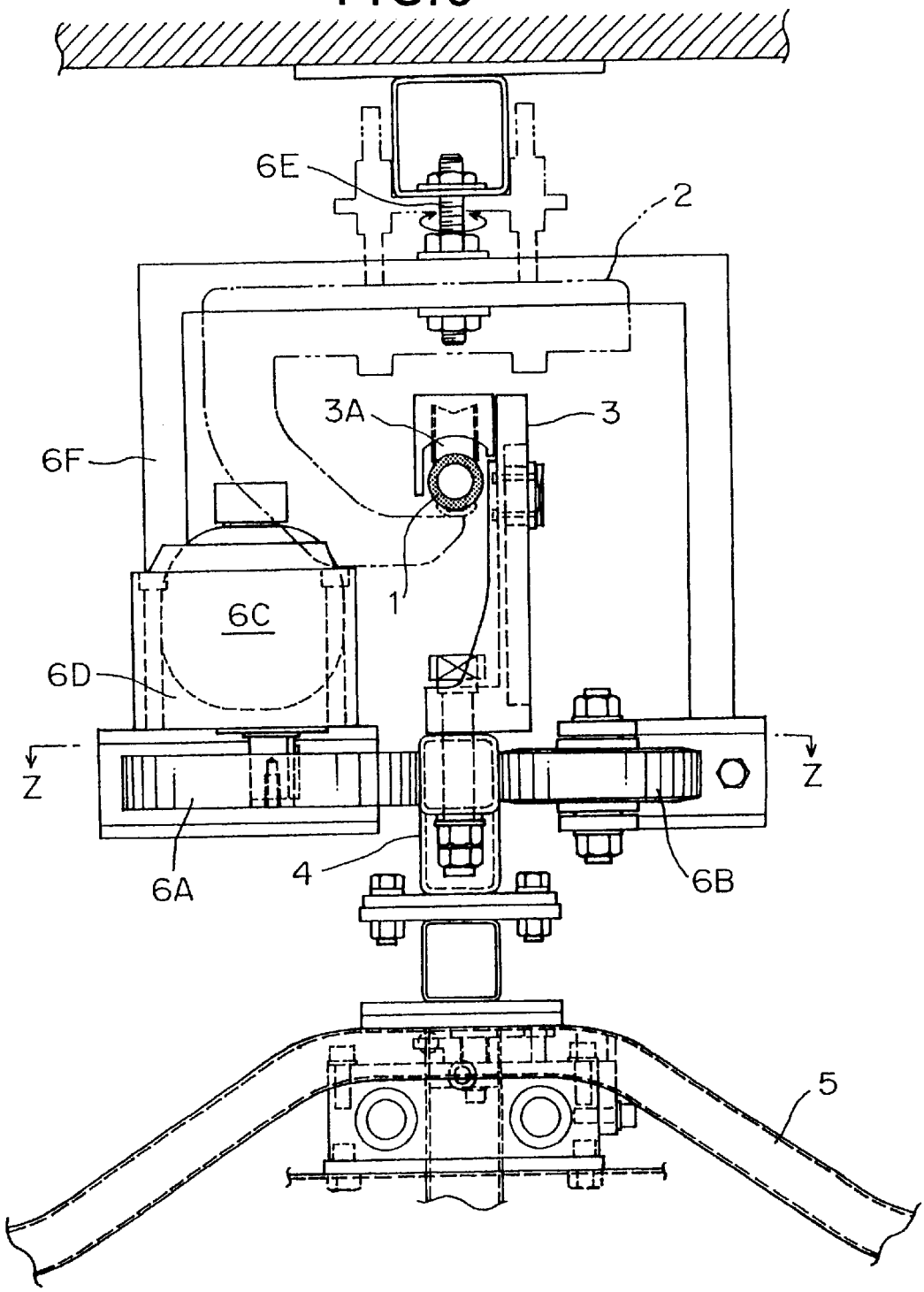
FIG. 3. is a transverse sectional view taken on plane Y—Y of FIG. 1, showing the conveyor in operation.

A trolley section of the conveyor is composed of multiple, inverted J-shaped hook members 3 that move along the conveyor rail 1 in the longitudinal direction, and driven bars 4 which are connected between the J-shaped hook members. As shown in FIGS. 2 and 3, rollers 3A are provided on the upper ends of the J-shaped hook members for engagement with the upper sides of the rail 1, allowing the J-shaped members to move smoothly along the rail. The driven bars 4 have hangers 5 attached to them for conveying a conveyed article W, in this case an automobile body. The face of the pulley which engages the rail is preferably concave so that the hook members can move smoothly along the rail in the longitudinal direction without the need for additional guide rollers. The curvature of the concave faces of the rollers preferably conforms to the curvature of the rail.

Figure 4:
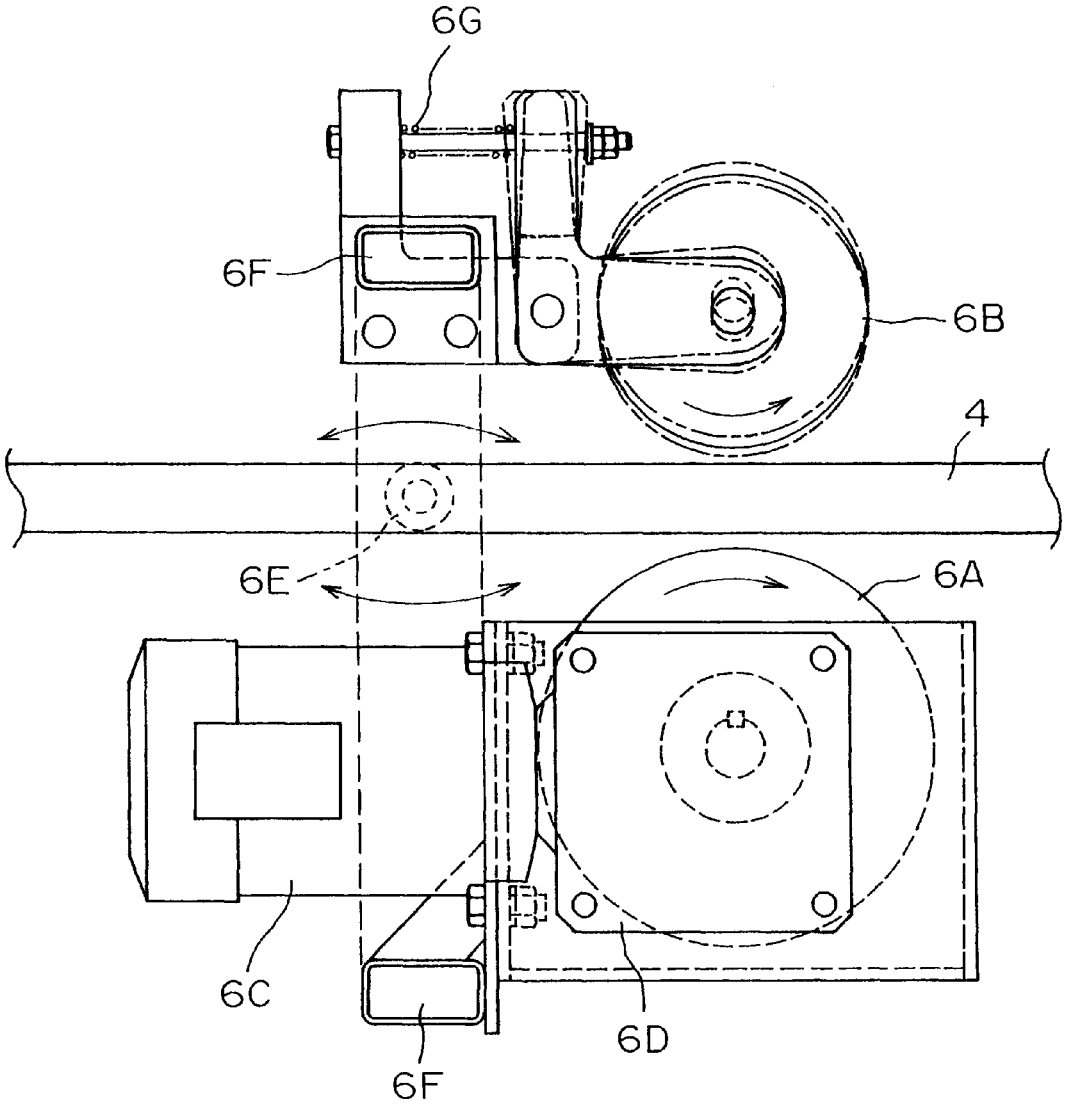
FIG. 4 is a horizontal sectional view taken on plane Z—Z of FIG. 3, illustrating the manner in which the friction drive means embraces a driven bar.

Friction drive means 6 are disposed at intervals along the conveyor line. As shown in FIGS. 3 and 4, the friction drive means embraces the driven bar 4 on both sides. In the embodiment shown, the side faces of the driven bar are flat, and the bar-engaging faces of the friction drive rollers are in the form of circular cylinders, so that the friction drive means engages the bars along lines of contact for optimum power transmitting efficiency.

The friction drive means is composed of a friction roller 6A, which engages one side of the driven bar 4 to drive the bar in the conveying direction, and an idler roller 6B, which comes into contact with the opposite side of the driven bar 4 to guide the bar in the conveying direction. The friction roller is rotated by a motor 6C through a reduction gear 6D.

The friction roller 6A and the free roller 6B of the friction drive means 6 are supported on a frame 6F, which is pivoted to swing freely on a vertical support shaft 6E, installed on a supporting bracket above the rail 1. As shown in FIG. 4, the rollers 6A and 6B are offset longitudinally from support shaft 6E, so that swinging of the frame 6F about the vertical axis of the support shaft can accommodate lateral movement of the driven bar 4 which occurs when the moving structure including the J-shaped hook members and the driven bar tends to roll and also when the driven bar traverses a curve in the conveyance path. Supported in this manner, the rollers avoid dislocations and kinks in the motion of the driven bar 4, especially when the driven bar exhibits a rolling motion or when it traverses a curve in the conveyor line. The frame-supported drive means 6 contributes to reliable and secure operation of the conveyor without loss of conveying force due to slippage.

As best seen in FIG. 4, the idler roller 6B is provided with a vibration absorbing mechanism 6G, the principal objective of which is to reduce or eliminate vibrations in the conveyor which would tend to loosen, and cause the failure of, fasteners such as nuts and bolts in the conveyor structure. The vibration absorbing mechanism flexibly absorbs roll vibrations likely to be generated in the conveyed articles W. In mechanism 6G, the idler roller 6B is pivoted on one end of an L-shaped swinging lever, and an elastic spring at the other end of the lever urges the idler roller 6B against the driven bar 4.

The friction drive system trolley conveyor described above is able to convey heavy articles W, such as car bodies, with relatively low noise production, and in a stable manner, without creating pitching or rolling motions. Moreover, the friction drive system trolley conveyor is structurally simple, especially by virtue of the conveyor rail 1. Another advantage of the conveyor is that it effectively utilizes a simplified hanging structure, in which inverted, J-shaped hook members 3 are hung on the conveyor rail and can be readily installed on or removed from the conveyor rail. Thus, maintenance tasks, such as the replacement of hook members, and lubrication can be carried out easily, with significant beneficial effect.

The friction drive system trolley conveyor in accordance with the invention exhibits the following effects.

First, the conveyor utilizes a conveyor rail having a circular cross-section, such that a roller having a concave surface, mounted on a J-shaped hook member, can contact the arcuate upper surface of the rail along a line of contact, for smooth operation with significant noise reduction. Moreover, the hollow, circular cross-section of the rail not only contributes the lightness in weight of the rail without sacrificing strength, but also contributes to the ease of installation of the conveyor, since the hollow rail can be bent readily to conform to the desired conveyor layout.

In the conveyor in accordance with the invention, while the inverted, J-shaped hook members move along the conveyor rail, the friction drive means supplies a conveying force to the driven bars suspended between successive hook members. Accordingly, the friction drive system is able to convey even a heavy car body smoothly, without the need for a conveyor chain or a carriage drive motor, as in conventional ceiling hung trolley chain conveyors and ceiling supported mobile carriage conveyors. Furthermore, the conveyor of the invention is simpler in construction and easier to maintain.

The load on the conveyor is also able to shift direction at curved corners of the conveyor rail, smoothly following the locus of the chord defined by the driven bar, suspended at two points. While shifting direction in this manner, the load maintains a stable attitude, and even a heavy load is able to be conveyed around a corner without pitching or rolling.

The friction roller and the free roller embrace the driven bar on both sides, and consequently the conveying force is transmitted to the driven bar without loss due to slippage, so that the conveying force is applied reliably and with a minimum power requirement.

Since the friction drive means is supported on a holding frame which is pivoted to swing freely, the friction drive is able to avoid kinking or dislocation which might otherwise occur when the driven bar when the driven bar tends to roll or when the driven bar is traversing a curve in the conveyor line. Consequently the conveyor is able to convey loads stably and reliably.

The invention being thus described, it will be apparent that the same may be varied in many ways. Such variations are not to be regarded as a departure from the spirit and scope of the invention, and all such modifications as would be obvious to one skilled in the art, when armed with the foregoing description, are intended to be included within the scope of the following claims.

What is claimed is:

1. A friction drive system trolley conveyor comprising:

a conveyor rail having a circular cross-section, an upper side and an underside, the rail extending in a longitudinal direction along a conveyor line;

multiple J-shaped rail suspension members that bear the underside of the conveyor rail at intervals along the longitudinal direction of the conveyor rail;

multiple inverted J-shaped hook members that engage and move along the upper side of the conveyor rail in the longitudinal direction;

a driven bar extending between the inverted J-shaped hook members, the driven bar suspending a conveyed material or article; and friction drive means disposed along the conveyor line, the friction drive means engaging both sides of the driven bar and effecting movement of the driven bar along the conveyor line.

2. A friction drive system trolley conveyor according to claim 1, wherein the friction drive means is supported by a holding frame freely pivoted to swing on a support shaft suspended from a location above the conveyor rail.

3. A friction drive system trolley conveyor according to claim 1, wherein the circular cross-section of the conveyor rail is hollow.

4. A friction drive system trolley conveyor according to claim 1, wherein both sides of the driven bar are flat and the friction drive means comprises circular, cylindrical rollers that engage both sides of the driven bar along lines of contact.

5. A friction drive system trolley conveyor according to claim 1, wherein the friction drive means comprises a friction roller which engages one side of the driven bar to effect movement of the driven bar along the conveyor line and an idler roller that contacts the driven bar on the side opposite to said one side to guide the driven bar.

6. A friction drive system trolley conveyor according to claim 5, wherein the friction drive means is supported by a holding frame freely pivoted to swing on a support shaft suspended from a location above the conveyor rail.

* * * * *